US006129606A

United States Patent [19]

Yuen

[11] Patent Number: 6,129,606

[45] Date of Patent: Oct. 10, 2000

[54] ACTION MECHANISM TOY OR AMUSEMENT DEVICE

[76] Inventor: Po Man Yuen, 159 Sanford Blvd., West, 3/FL, Mount Vernon, N.Y. 10550

[21] Appl. No.: 09/340,390

[22] Filed: Jun. 28, 1999

Related U.S. Application Data

[60] Provisional application No. 60/104,641, Oct. 16, 1998.

[51] Int. Cl.[7] ..... A63H 13/18

[52] U.S. Cl. ..... 446/325; 446/351; 446/486

[58] Field of Search ..... 446/351, 352, 446/353, 390, 396, 325, 326, 486; 40/411, 414, 420

[56] References Cited

U.S. PATENT DOCUMENTS

| | | | |
|---|---|---|---|
| 1,793,121 | 2/1931 | Muller . | |
| 2,554,516 | 5/1951 | Anthony . | |
| 3,452,473 | 7/1969 | Convertine . | |
| 4,708,690 | 11/1987 | Kulesza et al. | 446/351 |
| 5,221,225 | 6/1993 | Newbold et al. | 446/297 |
| 5,297,981 | 3/1994 | Maxim et al. | 446/437 |
| 5,316,516 | 5/1994 | Saitoh | 446/175 |
| 5,356,326 | 10/1994 | Ting | 446/175 |
| 5,964,639 | 10/1999 | Maxim | 446/437 |
| 5,993,286 | 11/1999 | Tacquard et al. | 446/351 |

*Primary Examiner*—Jacob K. Ackun
*Assistant Examiner*—Jeffrey D. Carlson
*Attorney, Agent, or Firm*—Shlesinger, Arkwright & Garvey LLP

[57] ABSTRACT

An action mechanism toy or amusement device which by centrifugal force causes the device to wobble, bob and rock due to a motor mechanism and offset weight rotating about a fixed motor shaft.

14 Claims, 3 Drawing Sheets

ACTION MECHANISM TOY OR AMUSEMENT DEVICE

APPLICATION HISTORY

This application is based on provisional Application Serial No. 60/104,641, filed Oct. 16, 1998.

FIELD OF THE INVENTION

This invention pertains to toys and amusement devices and more particularly to devices created by using the principal of centrifugal force in conjunction with a flexible extension to create a wobble, bobbing or rocking motion effect.

HISTORY AND BACKGROUND OF THE INVENTION

Isaacs U.S. Pat. No. 1,152,539 and Del Mas U.S. Pat. No. 2,760,303 are early inventions disclosing toys mounted on springs to impart rocking, bobbing or wobbling motion to a toy or amusement device.

Cohn U.S. Pat. No. 2,504,652 discloses a toy incorporating a power driven mechanism for creating a back-and-forth action to the toy.

Norton U.S. Pat. No. 5,169,354 provides an off-center weight to the driven shaft which creates a wobble or rocking motion to the device as do also the patents of Lin U.S. Pat. No. 5,360,366, Hughes U.S. Pat. No. 4,536,167 and Ku U.S. Pat. No. 5,720,644. In all of these developments, those that use a motor mechanism, have the drive shaft rotating to cause the offset weight to rotate.

OBJECT AND SUMMARY OF THE INVENTION

It is an object of this invention to provide a wobble, rocking or bobbing mechanism for toys and amusement devices in which the motor spindle remains stationary and the body of the motor rotates around the spindle including an offset weight to obtain the desired action.

Another object of this invention is to provide toys and the like which are inexpensive, durable and easily manufactured.

Still a further object of this invention is to provide a mechanism positioned a substantial distance from the base support on flexible means permitting a substantial action to the device.

In summary, this invention relates to toys having a wobble, bobbing or rocking mechanism which cause the toys or amusement devices to bob, wobble or rock due to the eccentric forces applied by an offset weight which moves with the main motor around a central fixed shaft in an orbit which goes up and down relative to the horizon.

These and other objects will be apparent from the following descriptions and the drawings which are described as follows:

BRIEF DESCRIPTIONS OF THE DRAWINGS

DETAILED DESCRIPTION OF THE INVENTION

Figure 1:
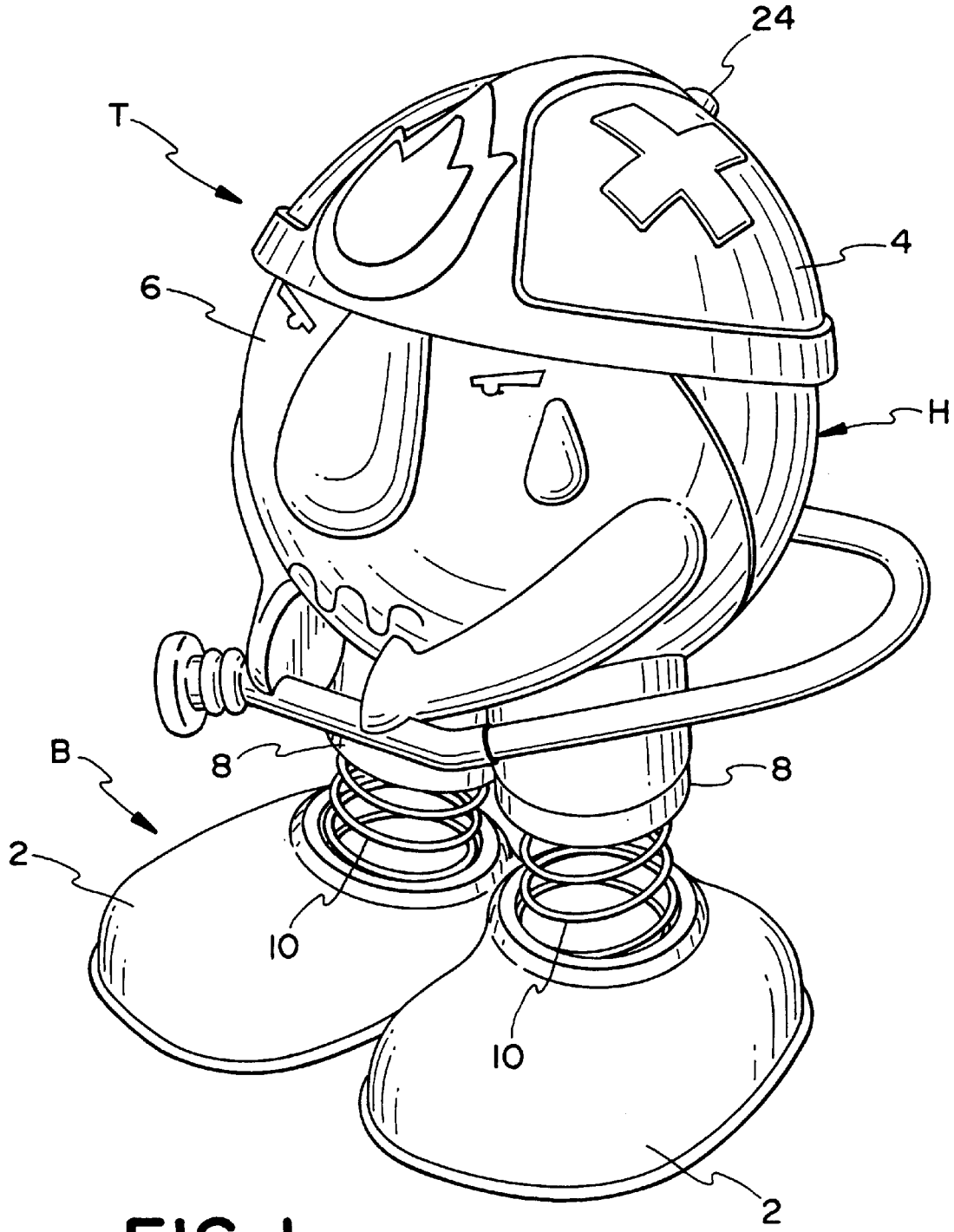
FIG. 1, is a front perspective and viewed in the direction of the arrows.
Figure 3:
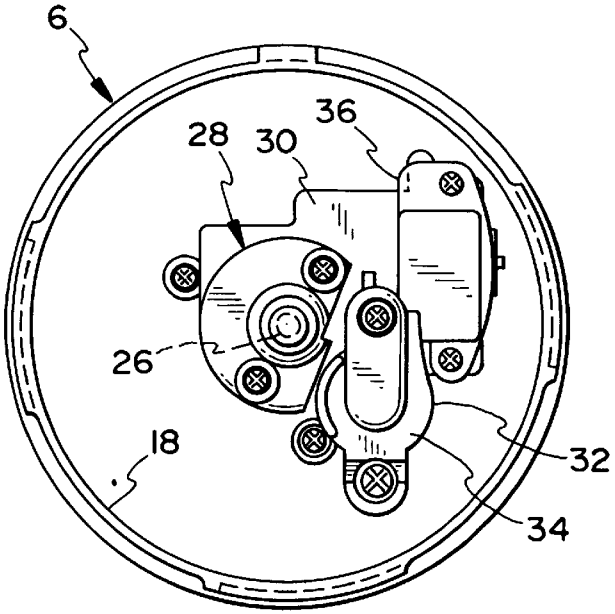
FIG. 3, is a cross-sectional view taken along the line 3—3 of FIG. 2, and viewed in the direction of the arrows.

Devices created by this invention will give rise to a rocking, bobbing or wobbling motion or action. Specifically, a spinning object is placed in a chamber or a container, where the spinning object is unbalanced about the spinning axis. The unbalance causes the chamber to wobble on its mount back and forth as the offset weight rotates about a central axis. When the chamber is attached to a flexible extension, the rocking, bobbing or wobble is created. Bobbing occurs when the spinning object spins on an axis which intersects the horizontal plane of an angle. This is due to the weight moving up and down vertically while also spinning.

In the Figures, the toy or the rocking mechanism T, which simulates a fireman figurine, includes a base B comprising a pair of spaced shoes or feet 2. Spaced above the shoes 2 is a housing H. The housing H comprises two interconnected shells 4 and 6 which are joined together by bayonet connections or threads (not shown) or the like. The shells 4 and 6 are substantial hemispheres with shell 4 being the front shell and shell 6 being the rear shell. At the bottom of shell 6 and mounted to shell 6 by adhesive or by heat sealing or screws or the like are upper legs 8. Each of legs 8 are provided with a coil spring 10 connected thereto at its upper end 12 and at its lower end 14 to feet or shoes 2. The coil springs 10 are sufficiently flexible to permit the housing H to flex thereon relative to the base B shoes or feet 2. The housing H, feet 2, upper legs 8 and coil springs 10 may be made of plastic, metal, glass or the like. Shell 6 of housing H includes a post 16 extending inwardly from the inside surface 18 of shell 6. Shell 4 is provided with an opening 20. Post 16 includes a bore hole 22. Mounted in the opening 20 is a motor on/off push button 24. Push button 24 is mounted on the motor shaft 26.

Figure 2:
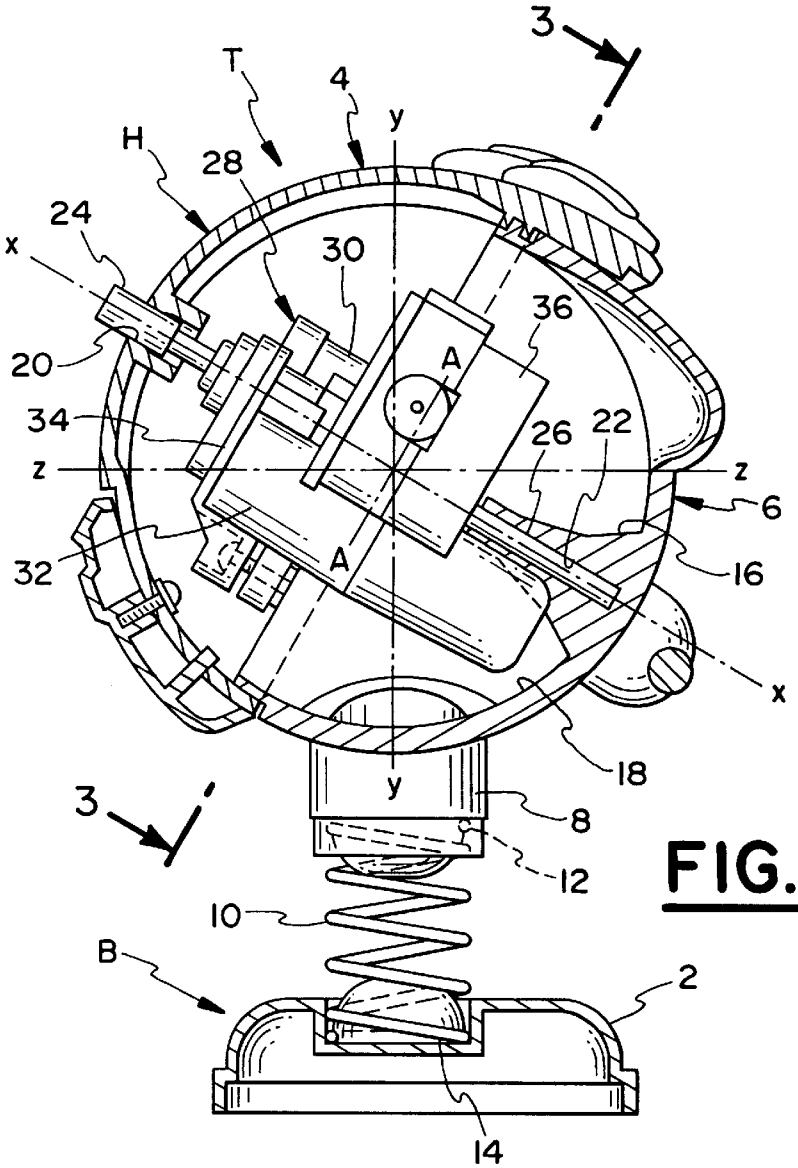
FIG. 2, is a cross-section of the invention.
Figure 4:
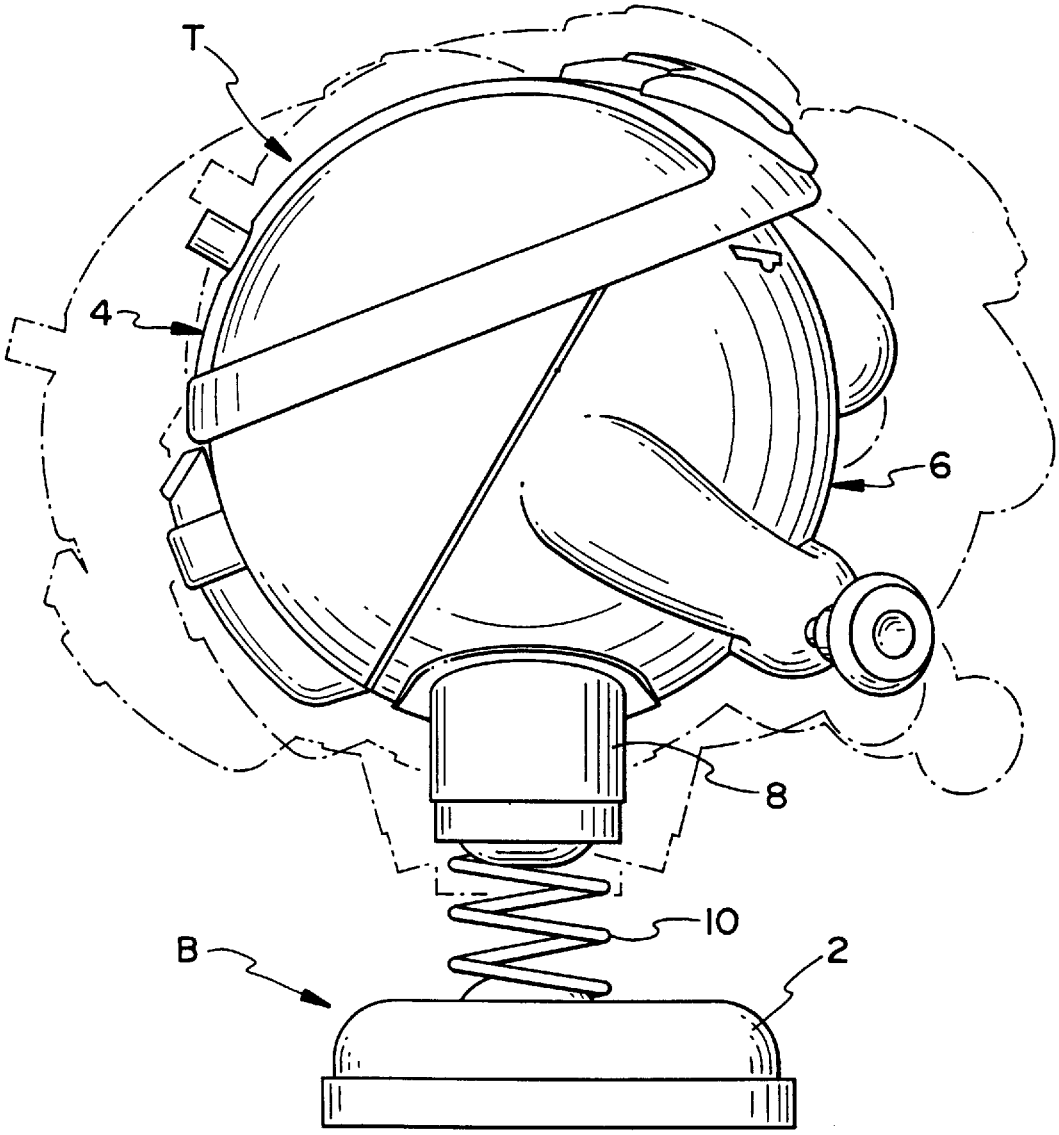
FIG. 4, is a side view of the device with its movement shown in phantom lines.

Motor shaft 26 is mounted in bore hole 22 and extends out of the bore hole 22 and is connected to push button 24 which is spring mounted to reciprocate on the spin axis X and on the end of the motor shaft 26 by spring means (not shown). FIG. 2 shows a vertical axis Y and a horizontal axis Z. Intersecting the horizontal axis Z and the vertical axis Y is intersecting axis A, as best shown in FIG. 2.

Mounted on the motor shaft 26 is the motor 28. Attached to the motor assembly housing 30 of the motor 28 is battery holder 32 integral with the motor assembly housing 30 and having a battery cap 34 for keeping the battery in position in the battery holder 32. The motor assembly housing 30 also includes gear box 36 for stepping down the rotational speed of the motor 28, the battery holder 32 and battery (not shown), battery cap 34 and the gear box 36. The battery holder 32 which includes a battery (not shown) becomes the offset weight along with the gears (not shown) in the gear box 36. The motor shaft 26 is fixed and does not rotate. Since the motor shaft 26 does not rotate, the motor 28 together with all of the components in the motor housing 30 including the battery holder 32 and battery (not shown) and the battery cap 34 and the gear box 36 all rotate about the motor shaft 26.

The action of the motor 28 and the components parts in the motor assembly housing 30 cause the housing H to vibrate thus giving a bobbing, wobbling or rocking motion to the housing H relative to the feet 2 because of the flexible coil springs 10.

Electrical connections from the battery (not shown) to the motor 28 are not shown, but are typical of electrical drive connections from a motor to a battery power source. Push button 24 activates a switch (not shown) to turn the motor on and off.

It must be noted that the toy T may have other figurine simulations and the housing or container H can assumed various shapes and forms. These would include spherical, elliptical, cubical, tetrahedral, conical, semi-spherical, etc. and not limited to the shape or form displayed in the drawings presented.

The materials used in this development can be metallic or non-metallic. The housing H could include a plurality of extensions or legs as desired in order to enhance the action. The legs or extensions could be flexible so as to wave back or forth. The extensions or legs to this device T can include any combination of fixed on non-fixed extensions or legs.

It should be noted that the axis X and the vertical axis Y form an angle which can vary. But for a bobbing, rocking and wobbling action when desired, the angle should vary from about 15° to about 85° from the horizontal axis Z. Preferably the angle should be from about 25° to about 35° from the horizontal plane of axis Z. Thus, the weight including the battery (not shown), battery holder 32 and gear box 36 moves up and down causing bobbing while rotating on the axis X. It should also be noted that the angle of attachment of the two shells 4 and 6 will be on a plane A intersecting the horizontal plane of axis Z at an angle from about 25° to 35°.

The gear box 36 regulates the rotation per minute of the motor 28 and the gear ratios can determine the amount of speed of the motor 28 about the shaft 26. The gear box 36 may be eliminated if the motor 28 is designed to spin at a speed which will not cause the device to tip over.

If the battery is a very small unit and is designed so as to not have sufficient weight to cause the action effect, a weight can be added offset from the shaft 26 to give the desired effect.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. An action mechanism toy or amusement device having:

a) a base support;

b) a housing;

c) a flexible connection connecting said base support to said housing;

d) said housing having a vertical axis and a horizontal axis relative to said base support;

e) said housing having a motor assembly including a non-rotatable motor shaft and a weight;

f) said motor assembly rotatable on said motor shaft;

g) said weight being offset laterally from said motor shaft and rotatable on said motor shaft with said motor;

h) means for actuating said motor;

i) said housing having a pair of interlocking and separable parts;

j) said pair of interlocking and separable parts lying in a plane transverse to the vertical axis of said housing and intersecting the horizontal plane of said horizontal axis of said housing;

k) said motor shaft extending from one of said pair of interlocking and separable parts to other of said pair of interlocking and separable parts;

l) said motor shaft being transverse to the vertical axis of said housing and perpendicular to the plane in which said pair of interlocking and separable parts lie;

m) whereby when said motor is actuated by said actuating means, said motor and said weight orbit about said motor shaft thereby causing said housing to rock and wobble on said flexible connection back-and-forth relative to said base.

2. An action mechanism as in claim 1, and wherein:

a) said motor shaft has an axis intersecting said vertical axis of said housing causing a bobbing action at an angle of from about 15° to about 85°.

3. An action mechanism as in claim 2, and wherein:

a) said motor shaft axis intersects said vertical axis at an angle of from about 25° to about 35°.

4. An action mechanism as in claim 1, and wherein:

a) said housing assembly motor shaft includes means for actuating said motor.

5. An action mechanism as in claim 4, and wherein:

a) said housing includes a pair of motor shaft mounts;

b) one of said pair of mounts being on one of said pair of interlocking and separable parts and the other of said pair of mounts being on the other of said pair of interlocking and separable parts.

6. An action mechanism as in claim 5, and wherein:

a) one of said pair of motor shaft mounts is an opening in said housing through which said means for actuating said motor is actuated.

7. An action mechanism as in claim 6, and wherein:

a) said means for actuating said motor is a push button on the motor shaft extending from said opening in said housing.

8. An action mechanism as in claim 1, and wherein:

a) said flexible connection is a spring system.

9. An action mechanism as in claim 8, and wherein:

a) said spring system is a pair of coil springs.

10. An action mechanism as in claim 9, and wherein:

a) said base support includes a pair of feet for said pair of coil springs.

11. An action mechanism as in claim 1, and wherein:

a) said housing simulates a figurine.

12. An action mechanism as in claim 6, and wherein:

a) said housing has a front and back and said housing opening is on said back.

13. An action mechanism as in claim 1, and wherein:

a) said interlocking and separable parts are substantially half shells.

14. An action mechanism as in claim 2, and wherein:

a) said weight when said motor is actuated induces a rotational and bobbing action to said action mechanism or amusement device.

* * * * *